US009361821B2

(12) United States Patent
Tani et al.

(10) Patent No.: US 9,361,821 B2
(45) Date of Patent: Jun. 7, 2016

(54) DISPLAY DEVICE

(71) Applicant: LG Display Co., Ltd., Seoul (KR)

(72) Inventors: Ryosuke Tani, Paju-si (KR); SungJin Hong, Goyang-si (KR); WooJin Nam, Goyang-si (KR); JongHo Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 8 days.

(21) Appl. No.: 14/328,254

(22) Filed: Jul. 10, 2014

(65) Prior Publication Data

US 2015/0179103 A1 Jun. 25, 2015

(30) Foreign Application Priority Data

Dec. 19, 2013 (KR) ..... 10-2013-0159701

(51) Int. Cl.
*G09G 3/20* (2006.01)

(52) U.S. Cl.
CPC ..... *G09G 3/20* (2013.01); *G09G 2310/027* (2013.01); *G09G 2320/0209* (2013.01); *G09G 2320/0271* (2013.01); *G09G 2320/0276* (2013.01); *G09G 2360/16* (2013.01)

(58) Field of Classification Search
CPC ..... G09G 3/3258; G09G 2320/0276; G09G 3/14
See application file for complete search history.

(56) References Cited

U.S. PATENT DOCUMENTS

2002/0186230 A1* 12/2002 Kudo ..... G09G 3/3607 345/690
2005/0083268 A1* 4/2005 Mori ..... G06F 3/147 345/76
2006/0214940 A1* 9/2006 Kinoshita ..... G09G 3/2096 345/589
2006/0279498 A1* 12/2006 Kaneda ..... G09G 3/3696 345/89
2007/0268218 A1* 11/2007 Mizukoshi ..... G09G 3/3233 345/76
2010/0328535 A1* 12/2010 Okui ..... G09G 3/20 348/578
2012/0268504 A1* 10/2012 Irie ..... G09G 3/3614 345/690

* cited by examiner

*Primary Examiner* — Kevin M Nguyen
(74) *Attorney, Agent, or Firm* — Fenwick & West LLP

(57) ABSTRACT

A display device includes: a display panel in which a plurality of data lines and a plurality of gate lines intersect in a matrix form and pixels are formed at intersecting points thereof; a data drive unit connected to the plurality of data lines and configured to output a black data voltage corresponding to a gradation level of 0 and expressing the black data voltage as a third voltage through the data lines, the third voltage greater than a first voltage, which is a minimum output value, and less than or equal to a second voltage corresponding to a gradation level of 0 when linearly extending data voltages of two or more low gradation levels; a gamma voltage supply unit outputting a gamma voltage for each gradation level to the data drive unit; and a timing controller generating a control signal to control driving of the display panel.

20 Claims, 9 Drawing Sheets

100

DISPLAY DEVICE

CROSS-REFERENCE TO RELATED APPLICATION

This application claims priority under 35 U.S.C. §11.9(a) from Korean Patent Application No. 10-2013-0159701, filed on Dec. 19, 2013, which is hereby incorporated by reference for all purposes as if fully set forth herein.

BACKGROUND OF THE INVENTION

1. Field of the Invention

The present invention relates to a display device configured to display an image.

2. Description of the Prior Art

As our information-oriented society has developed, the demand for display devices that display images has increased. Recently, various display devices such as a Liquid Crystal Display (LCD), a Plasma Display Panel (PDP), and an Organic Light Emitting Diode (OLED) Display Device have been used.

Such display devices experience a problematic horizontal crosstalk phenomenon where variation in a data voltage supplied to one of the data lines is transferred through a gate line, thereby affecting a data voltage supplied to another data line.

SUMMARY OF THE INVENTION

In one aspect, the present invention reduces horizontal crosstalk in a display device.

In accordance with an aspect of the present invention, a display device includes: a display panel in which a plurality of data lines and a plurality of gate lines intersect in a matrix form having pixels that are formed at intersecting points thereof (e.g., intersections between gate lines and data lines); a data drive unit connected to the plurality of data lines and outputting a black data voltage that corresponds to a gradation level of 0 and that expresses the black data voltage as a third voltage through the data lines, the third voltage being greater than a first voltage which is a minimum output value, and less than or equal to a second voltage corresponding to the gradation level of 0 when linearly extending data voltages of two or more low gradation levels; a gamma voltage supply unit outputting a gamma voltage for each gradation level to the data drive unit; and a timing controller generating a control signal to control driving of the display panel.

Using the display device described above, horizontal crosstalk can be reduced.

BRIEF DESCRIPTION OF THE DRAWINGS

The above and other features and advantages of the present invention will be more apparent from the following detailed description taken in conjunction with the accompanying drawings, in which.

DETAILED DESCRIPTION OF THE EXEMPLARY EMBODIMENTS

Figure 1:
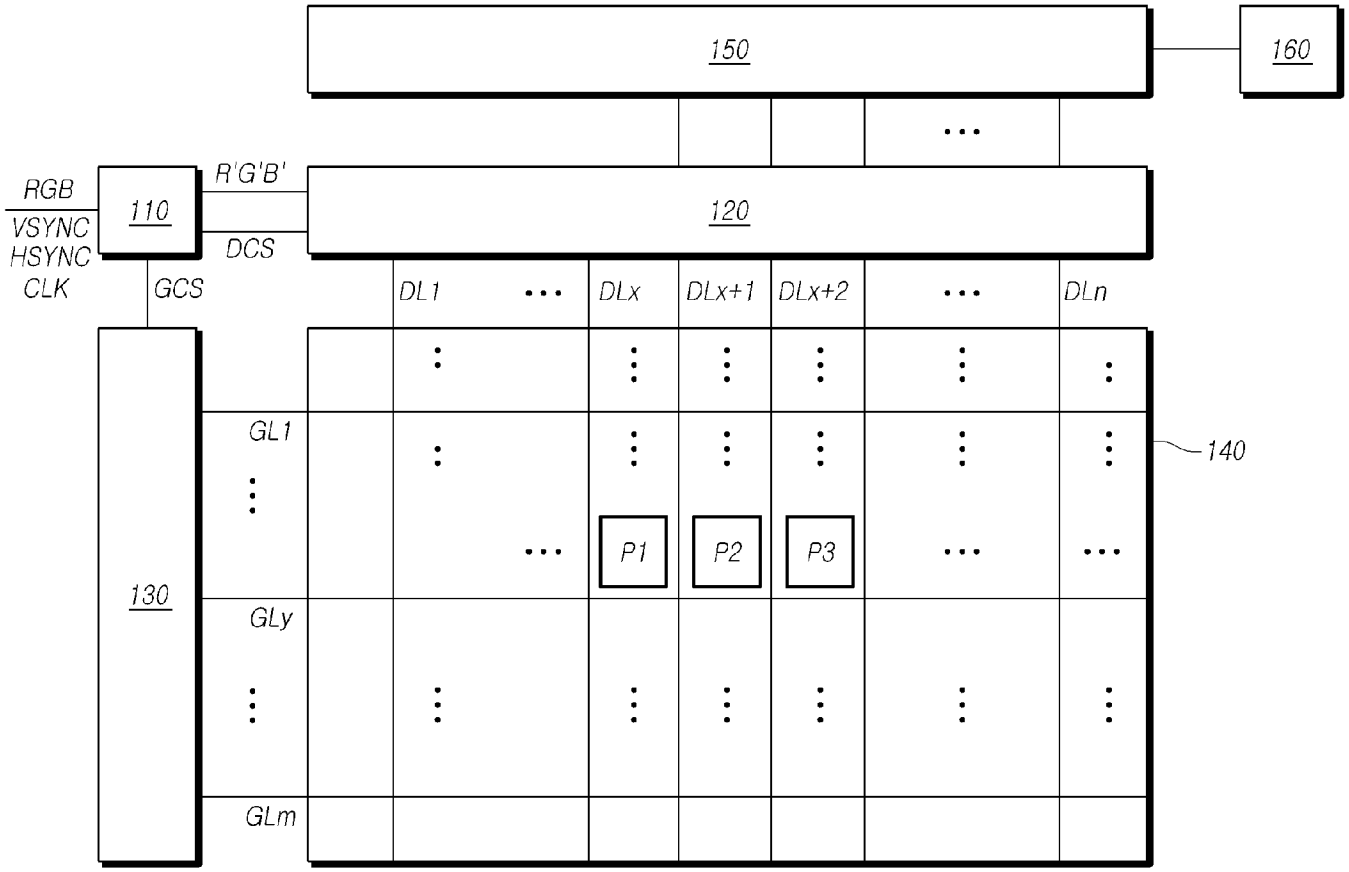
FIG. 1 illustrates a system configuration of a display device according to an embodiment.

Hereinafter, embodiments of the present invention will be described with reference to the accompanying drawings. In the following description, the same elements will be designated by the same reference numerals although they are shown in different drawings. Further, in the following description, a detailed description of known functions and configurations incorporated herein will be omitted when it may make the subject matter of the present invention unclear.

In addition, terms, such as first, second, A, B, (a), (b) or the like may be used herein when describing components of the present invention. Each of these terminologies is not used to define an essence, order, or sequence of a corresponding component but used merely to distinguish the corresponding component from other component(s). It should be noted that if it is described in the specification that one component is "connected," "coupled," or "joined" to another component, a third component may be "interposed" between the first and second components, although the first component may be directly "connected," "coupled," or "joined" to the second component. In the same context, it shall be understood that, when it is described that any component is formed "above" or "below" another component, the former may be formed on the latter directly or indirectly through a third component.

FIG. 1 illustrates a system configuration of a display device 100 according to an embodiment.

Referring to FIG. 1, a display device 100 according to one embodiment may include a timing controller 110 configured to control driving of a display panel 140, a data drive unit 120 connected with a plurality of data lines, a gate drive unit 130 connected with a plurality of gate lines, and the display panel 140 in which the plurality of data lines and the plurality of gate lines intersect in a matrix form. Pixels are formed at intersections of a data line and a gate line.

The timing controller 110 receives an input of a timing signal such as a vertical synchronizing signal (Vsync), a horizontal synchronizing signal (Hsync), a data enable signal (DE), or a clock signal (CLK), and generates control signals such as a gate control signal (GCS) and a data control signal (DCS) to control the data drive unit 120 and the gate drive unit 130, respectively. In addition, the timing controller 110 generates a gamma control signal used by a gamma voltage supply unit 150 to generate and supply a gamma voltage to the data drive unit 120.

In addition, the timing controller 110 supplies digital video data (R'G'B') obtained by sampling and then re-arranging digital video data (RGB) input from a system to the data drive unit 120. The digital video data (R'G'B') contains luminance information of each pixel, and the luminance has a predetermined number of gradation levels, for example, 1024 ($2^{10}$), 256 ($2^8$), 128 ($2^7$) or 64 ($2^6$) gradation levels.

Here, the vertical synchronizing signal (Vsync) and the horizontal synchronizing signal (Hsync) are signals for synchronizing the digital video data (R'G'B'). The vertical synchronizing signal (Vsync) is a signal for distinguishing frames and is input during one frame cycle, and the horizontal synchronizing signal (Hsync) is a signal for distinguishing the gate lines in one frame and is input during one gate line cycle. The data enable signal (DE) refers to a signal that indicates when a pixel is supplied data and that indicates a time point for supplying data to a pixel. The vertical synchronizing signal (Vsync), the horizontal synchronizing signal (Hsync), and the data enable signal (DE) function are based on a clock signal (CLK).

The gate control signal (GCS) includes a gate start pulse (GSP), a gate shift clock signal (GSC), and a gate output enable signal (GOE). The gate start pulse (GSP) indicates a start horizontal line where scanning is started during one vertical period where one frame is displayed. The gate shift clock signal (GSC) is a timing control signal input to a shift register within the gate drive unit 130 to sequentially shift the gate start pulse (GSP) in which the gate shift clock signal (GSC) is generated with a pulse width corresponding to an ON period of a drive transistor. The gate output enable signal (GOE) indicates an output of the gate drive unit 130.

In addition, the data control signal (DCS) includes a source start pulse (SSP), a source sampling clock (SSC), and a source output enable signal (SOE). The source start pulse (SSP) indicates a start pixel in one horizontal line where data will be displayed. The source sampling clock (SSC) directs a latch operation of data within the data drive unit 120 based on a rising edge or a falling edge of the source sampling clock (SSC). The source output enable signal (SOE) indicates an output of the data drive unit 120.

The data drive unit 120 latches the digital video data (R'G'B'), generates an analog data voltage using an analog gamma voltage based on the latched digital video data, and supplies the data voltage to data lines DL1 to DLn under the control of the timing controller 110.

The gate drive unit 130 includes a shift resister, a level shifter configured to convert an output signal of the shift register to a swing width suitable for driving a liquid crystal cell, and output buffers connected between the level shifter and the gate lines GL1 to GLm. The gate drive unit 130 outputs scan pulses having a pulse width of about one horizontal period.

In the display panel 140, the plurality of data lines and the plurality of gate lines intersect in a matrix form. Pixels are formed at intersections between data lines and gate lines. A substrate of the display panel 140 is formed with n×m pixels, which include drive transistors formed at the intersecting points of n data lines DL1 to DLn and m gate lines GL1 to GLm, respectively, pixel electrodes PXL connected to the drive transistors, respectively, and a storage capacitor Cst. For example, the display panel 140 may be an OLED display panel formed with n×m pixels, each of which includes an organic light emitting layer and a common electrode.

The gamma voltage supply unit 150 may generate a gamma reference voltage using a power supply voltage supplied from a power supply unit 160. The gamma voltage supply unit 150 may generate a plurality of gamma voltages according to a set gamma curve using the gamma reference voltage and may transfer the gamma voltages to the data drive unit 120.

For example, the gamma voltage supply unit 150 is a Programmable Power Integrated Circuit (PPIC). The gamma voltage supply unit 150 may be included in the data drive unit 120 or in the timing controller 110. In addition, some components of the gamma voltage supply unit 150 may be included in the data drive unit 120 or in the timing controller 110. The gamma voltage supply unit 150 included in the display device 100 according to one embodiment will be described below in detail with reference to FIGS. 3 to 9.

The power supply unit 160 is supplied with a voltage from the outside to generate voltages of various levels for driving the components of the display device 100 and to apply the voltages to the components of the display device 100.

The gamma voltage supply unit 150 and the power supply unit 160 may be integrated in a single integrated circuit.

Figure 2:
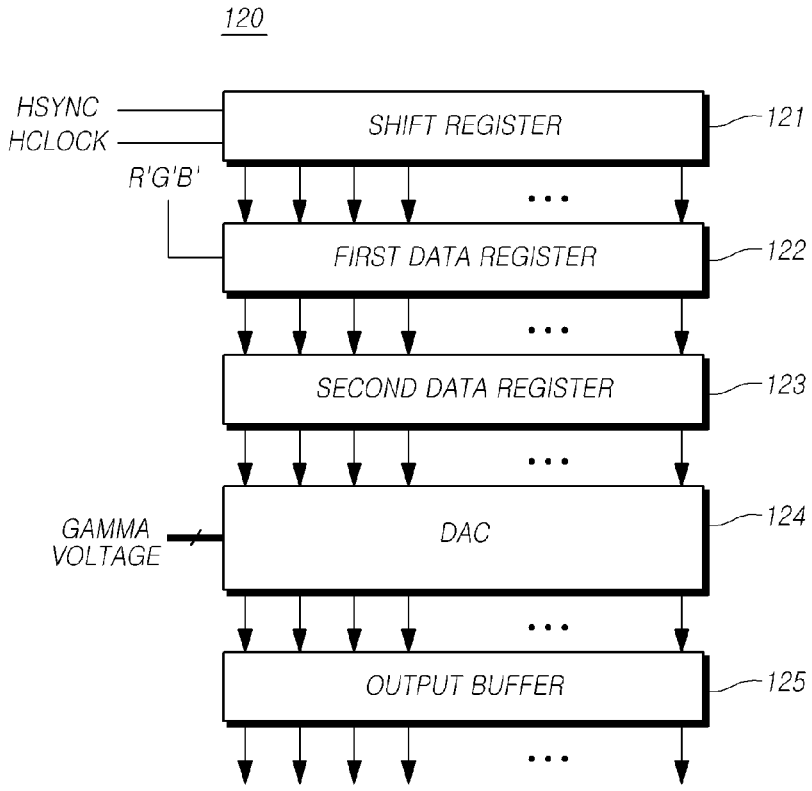
FIG. 2 is a diagram illustrating a configuration of a data drive unit included in the display device of FIG. 1.

FIG. 2 is a diagram illustrating a configuration of a data drive unit 120 included in the display device of FIG. 1.

Referring to FIG. 2, the data drive unit 120 included in the display device 100 may include a shift register 121, a first data register 122, a second data register 123, a digital-to-analog converter (DAC) 124, and an output buffer 125.

The shift register 121 controls the operating time of a horizontal clock signal (Hclock) and a horizontal synchronizing signal (Hsync) to drive the pixels line by line. That is, the shift register 121 receives an input of the horizontal synchronizing signal (Hsync) and the horizontal clock signal (Hclock) from the timing controller 110 and causes the data (Data') corresponding to one gate line (GL) (which selects the horizontal synchronizing signal (Hsync) as the start signal) to be synchronized with the horizontal clock signal Hclock, sequentially sampled, and stored in the first data register 122.

The first data register 122 stores in sequence the digital video data (R'G'B') to be displayed by the pixels of the $(m-1)^{th}$ gate line GL(m−1).

The second data register 123 stores the data (R'G'B') stored in the first data register 122 according to the next horizontal synchronizing signal (Hsync). Meanwhile, the first data register 122 stores in sequence the digital video data (R'G'B') to be displayed by the pixels of the $m^{th}$ gate line GLm.

The first data register 122 and the second data register 123 described above may be implemented by latches in which the outputs and inputs are connected by two inverters; thus, the first data register 122 and the second resister 123 may also be referred to as a first latch and a second latch, respectively.

The DAC 124 converts the digital video data (R'G'B') stored in the second data register 123 into an analog data voltage based on the gamma voltage supplied from the gamma voltage supply unit 150.

The output buffer 125 amplifies a pixel drive force (based on the analog voltage from the DAC 124) such that the pixel drive force has a current drive performance sufficient for driving a data line, and supplies the data voltage through the data line.

Figure 3:
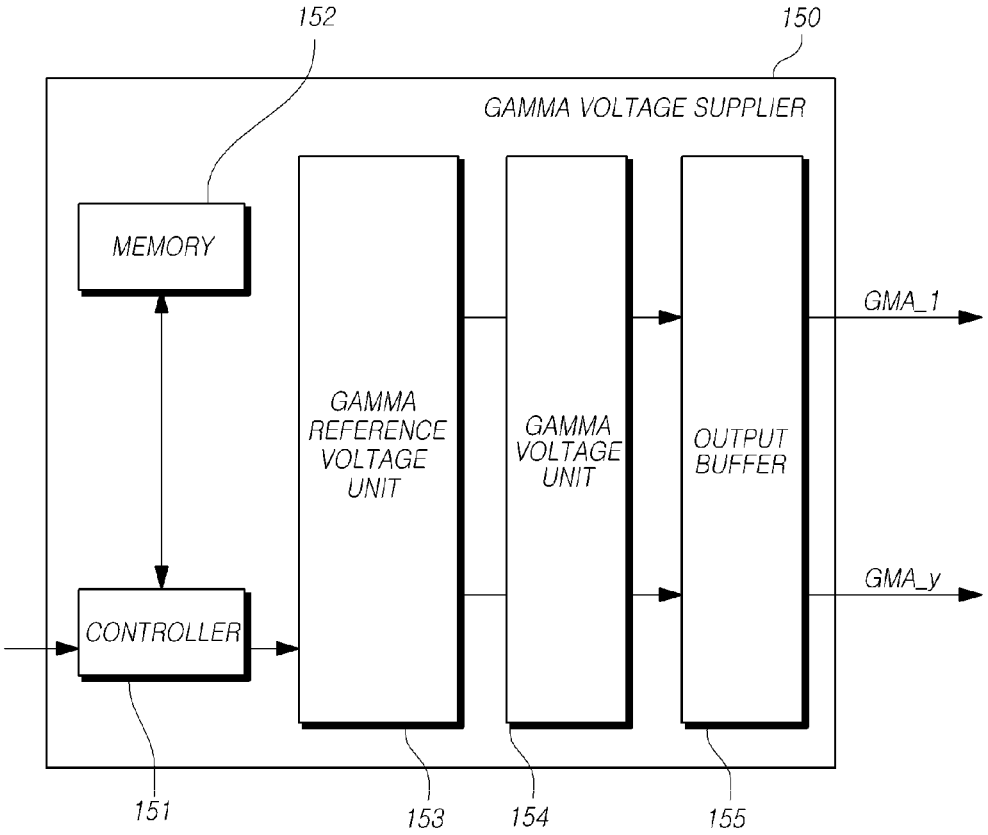
FIG. 3 is a diagram illustrating a configuration of the gamma voltage supply unit of the display device of FIG. 1.

FIG. 3 is a diagram illustrating a configuration of the gamma voltage supply unit 150 of the display device of FIG. 1.

Referring to FIG. 3, the gamma voltage supply unit 150 outputs the gamma voltage generated using the gamma reference voltage to the data drive unit 120.

For this purpose, the gamma voltage supply unit 150 may include a controller 151, a memory 152, a gamma reference voltage unit 153, a gamma voltage unit 154, and an output buffer 155.

The controller 151, the memory 152, the gamma reference voltage unit 153, the gamma voltage unit 154, and the output buffer 155 may be integrated in a single integrated circuit or some of them may be positioned outside the integrated circuit.

The controller 151 receives a gamma control signal from the timing controller 110, and reads data stored in the memory 152 which is used for generating a gamma reference voltage and is stored in the memory according to the gamma control signal in order to control the gamma reference voltage unit 153. The controller 151 may perform a communication function to send a gamma signal to the timing controller 110 or to receive a gamma control signal from the timing controller 110. For example, the controller implements $I^2C$ communication, which is a protocol for serial communication. The controller 151 may be included in the timing controller 110.

The memory 152 stores gamma data or gamma reference voltage setting data used for generating first to $x^{th}$ gamma reference voltages GRV_1 to GRV_x (1<x<y, where x and y are natural numbers) according to the gamma curve. The gamma data or gamma reference voltage setting data is supplied to the gamma reference voltage unit 153. For example, when the number of gamma reference voltages is nine (9), the memory 152 may store the magnitude of each of the nine gamma reference voltages in a look-up table form as in Table 1. Different magnitudes of the gamma reference voltages may be stored for respective display panels 140 according to gamma values on the gamma curve for each display panel 140, for example, 2.2 to 2.5.

TABLE 1

| | Gamma Data | | | | | | | | |
|---|---|---|---|---|---|---|---|---|---|
| | Gamma Ref. Value | | | | | | | | |
| | GRV_1 | GRV_2 | GRV_3 | GRV_4 | GRV_5 | GRV_6 | GRV_7 | GRV_8 | GRV_9 |
| Magnitude | V1 | V2 | V3 | V4 | V5 | V6 | V7 | V8 | V9 |

In particular, the gamma data stored in the memory 152 may contain different gamma reference voltages for red pixels (R), green pixels (G), and blue pixels (B). These different gamma reference voltages are used to generate different gamma voltages for the R, G, and B pixels according to their characteristics.

The memory 152 may be positioned inside of the gamma voltage supply unit 150 as illustrated in FIG. 3. However, a memory positioned inside or outside of the timing controller 110 (for example, an electrically erasable programmable read-only memory (EEPROM)) may be used as the memory 152. In addition, the memory 152 may be a volatile memory in which gamma data used for generating a gamma reference voltage may be changed.

The timing controller 110 may directly change the data required for generating a gamma reference voltage stored in the memory 152 through a serial communication protocol such as $I^2C$ with the memory 152, or the timing controller 110 may perform a serial communication with the controller 151 of the gamma voltage supply unit 150 to change the data used for generating a gamma reference voltage stored in the memory 152 through the controller 151 of the gamma voltage supply unit 150.

The controller 151 reads gamma data from the memory 152 and then sends the gamma data to the gamma reference voltage unit 153.

The gamma reference voltage unit 153 may generate a gamma reference voltage using the power supply voltage Vdd applied thereto by the power supply unit 160 according to the control of the controller 151. The gamma reference voltage unit 153 may be two or more digital-analog converters DAC which receive an input of the data stored in the memory 152 by the controller 151 to generate first to $x^{th}$ gamma reference voltages GRV_1 to GRV_x. The first to $x^{th}$ gamma reference voltages GRV_1 to GRV_x may be values arranged according to the order levels of electric potentials from the highest level. The first to $x^{th}$ gamma reference voltages GRV_1 to GRV_x are provided to the gamma voltage unit 154.

The gamma voltage unit 154 may generate first to $y^{th}$ gamma voltages GV_1 to GV_y (0<x<y, where x and y are natural numbers) using serially connected resistors as voltage dividers between the gamma reference voltages.

Figure 4:
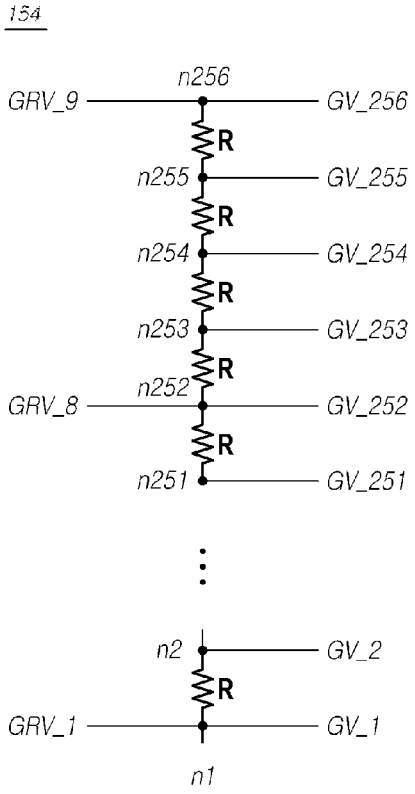
FIG. 4 is a circuit diagram of an example gamma voltage unit of FIG. 3 in which x=9 and y=256.

FIG. 4 is a circuit diagram of a gamma voltage unit 154 of FIG. 3 in which x=9 and y=256.

Referring to FIG. 4, the gamma voltage unit 154 may include an array of resistors in which resistors R are arranged in series. The values of the resistors may be equal to each other or different from each other, or the values of some of the resistors may be different from those of the other resistors. The array of resistors may be formed as a single resistor string.

The array of resistors may divide an electric potential between the first gamma voltage GV_1 and the $256^{th}$ gamma voltage GV_256. The electric potential at a first node n1 may be the first gamma voltage GV_1, the electric potential at the $256^{th}$ node n256 may be the $256^{th}$ gamma voltage GV_256, and the voltages of the second to $255^{th}$ nodes n2 to n255 (in which the first node n1 and the $256^{th}$ node n256 are separated from each other) may be the second to $255^{th}$ gamma voltages GV_2 to GV_255, respectively.

The first to $256^{th}$ gamma voltages GV_1 to GV_256 may be arranged in the order of levels of electric potential from the lowest level. That is, the electric potential of the $256^{th}$ voltage GV_256 may be the highest and the electric potential of the first gamma voltage GV_1 may be the lowest.

When the gamma reference voltages GRV_1 to GRV_9 provided to the gamma voltage unit 154 from the above-mentioned gamma reference voltage unit 153 are changed, values of the first to $256^{th}$ gamma voltages GV_1 to GV_256 may be changed. The controller 151 reads the gamma data (e.g., Table 1) stored in the memory 152 and provides the gamma data to the gamma reference voltage unit 153 to generate the gamma reference voltages GRV_1 to GRV_9. Accordingly, since the gamma data stored in the memory 152 is changed when releasing the display device 100 or during the use of the display device 100, the values of first to $256^{th}$ gamma voltages GV_1 to GV_256 can be changed by changing the gamma reference voltages GRV_1 to GRV_9 without changing other components.

The first gamma reference voltage GRV_1 may be supplied to the first node n1 so as to make the electric potential of the first gamma voltage GV_1 equal to the electric potential of the first gamma reference voltage GRV_1. The $9^{th}$ gamma reference voltage GRV_9 is supplied to the $256^{th}$ node n256 so as to make the electric potential of the $256^{th}$ gamma voltage GV_256 equal to the electric potential of the $9^{th}$ gamma reference voltage GRV_9. Each of the second to $8^{th}$ gamma reference voltages GRV_2 to GRV_8 is supplied to one of the second to $255^{th}$ nodes n2 to n255 so as to make the electric potentials of the voltages output from the nodes equal to the electric potentials of the supplied gamma reference voltages. FIG. 4 illustrates that the $8^{th}$ gamma reference voltage GRV_8 is supplied to the $252^{nd}$ node merely as an example. The node supplied with the $8^{th}$ gamma reference voltage GRV_8 may be changed. In this manner, the gamma reference voltages GRV_1 to GRV_9 may provide the gamma voltage unit 154 with a reference for generating the first to $256^{th}$ voltages GV_1 to GV_256 so as to control the values of the first to $256^{th}$ voltages GV_1 to GV_256.

As described above, some of the output terminals of the gamma voltage unit 154 are configured to be equal to some of the input terminals of the gamma voltage unit. The magnitude of voltage of each of the gamma reference voltages according to a gamma curve (which uses different values depending on a characteristic of the display panel 140, a characteristic of a drive element, or a characteristic of each pixel) is stored as gamma data in the memory 152. The control unit 151 supplies the gamma data to the gamma reference voltage unit 153. Thus, the gamma voltages of the gamma voltage unit 154 can be controlled.

The output buffer 155 outputs the gamma voltages input from the gamma voltages 154 to the data drive unit 120. Each of the first to $256^{th}$ gamma voltages output from the output buffer 155 may be equal to each of the first to $256^{th}$ voltages GV_1 to GV_256 input from the gamma voltage unit 154 or may be changed.

The data drive unit 120 converts the digital video data (R'G'B') into analog data voltages Vout1 to Voutn using the gamma voltages and supplies the data voltages to the data lines DL1 to DLn.

Figure 5:
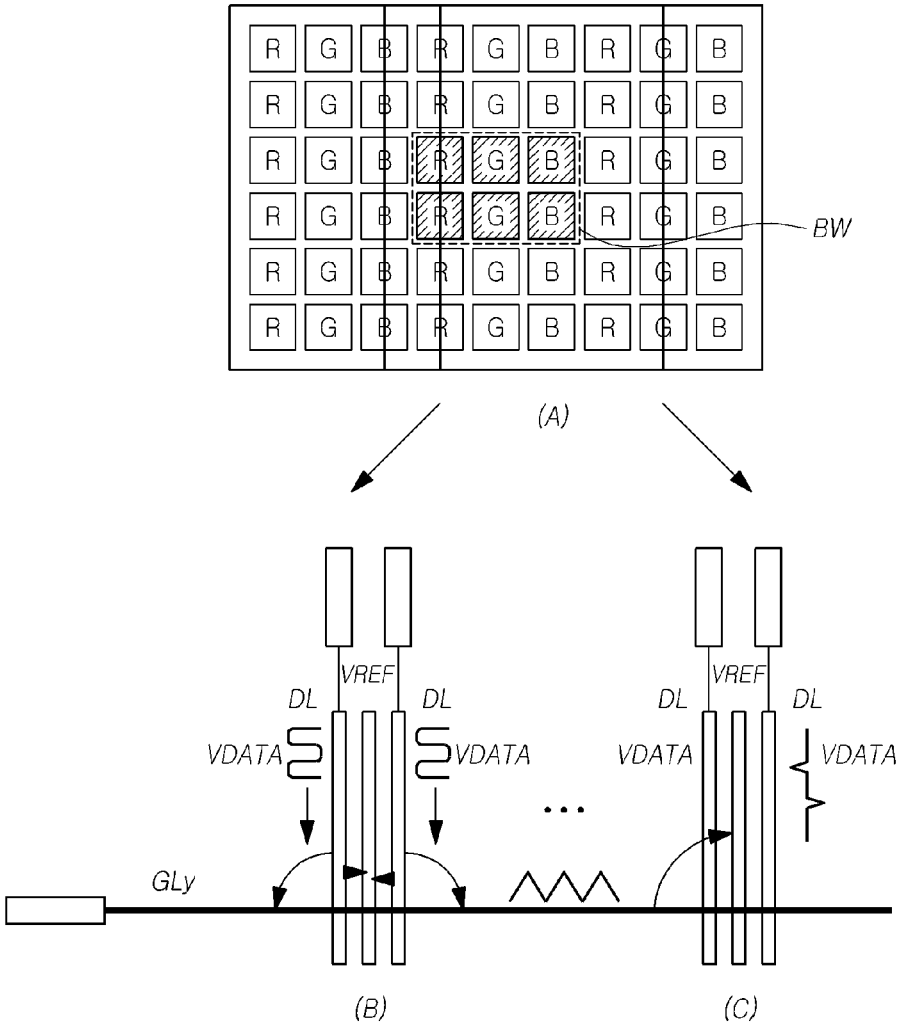
FIG. 5 illustrates an example pattern including a box window that causes horizontal crosstalk.

FIG. 5 illustrates an example pattern including a box window that causes horizontal crosstalk.

As illustrated in FIG. 5, part (A), in the display panel 140, it is possible to display a specific pattern that causes horizontal crosstalk. For example, it is possible to display a black window box BW that implements black (also referred to as the lowest gradation level or a gradation level of 0) in a specific region of a screen that implements white (also referred to as the highest gradation level). That is, the pixels positioned in the black window BW may equally display black and the pixels positioned in the remaining region other than the black window box BW may equally display white.

The voltage drop of the data voltage supplied to a data line connected with the pixels that do not display the black window box BW is relatively low but the voltage drop of the data voltage supplied to a data line connected with the pixels that display the black window box BW is relatively high. In particular, a voltage difference occurs along the gate lines positioned in a section that includes the black window box BW and the gate lines positioned in a section that does not include the black window box BW.

When the black window box BW is displayed on the display panel 140, the variation in the data voltages in the black window box BW is transferred in the horizontal direction and the data voltages are shaken due to a kickback (field through) effect caused by the variation in the data voltages. As a result, line-shaped horizontal crosstalk may be generated in the horizontal direction at the boundary or edge of the black window box BW. For example, as illustrated in FIG. 5, part (B), the variation in the data voltages Vdata of two data lines positioned at the boundary of the black window box BW may be directly transferred to the common voltage supplied to a common wiring Vref. Otherwise, as illustrated in FIG. 5, part (C), the variation in the data voltage positioned in the black window box BW may be transferred in the horizontal direction of the display panel 140 through a gate line GLy and the data voltage implementing the white positioned outside the black window box BW may be coupled with the variation in the data voltage transferred through the gate lines to change the common voltage.

One example pattern that causes the horizontal crosstalk has been described above as the black window box but is not limited thereto. Another example pattern may be a white window box that implements white in a specific region of a screen which implements black or a mosaic pattern in which white gradation regions and black gradation regions are repeated.

As described above, the gamma data set (that depends on a characteristic of a drive transistor which is a drive component of a display panel 140 and that is stored in the memory 152 of the gamma voltage supply unit 150) may differ from display panel 140 to display panel 140. In order to minimize consumed power of the display panel and to secure a contrast ratio when setting the black data voltage to implement black among the gamma data stored in the memory 152 (e.g. the data voltage corresponding to the gradation level of 0) the black data voltage may be set to be constant to a first voltage which is the minimum output value of the data drive unit 120, (for example, to a level of 0.2V to 1.1V) regardless of the characteristics of the display panel 140. In one example OLED display panel 140, the contrast ratio is improved such that, even when the black data voltage is set to the minimum output value of the data drive unit 120, an inter-black gradation level change of 0.001 nit or less may be expressed. In order to finely express a low gradation region, the display panel 140 should be able to express a change of 0.001 nit or less based on luminance.

When the display panel 140 (in which the black data voltage is set to be constant to the first voltage which is the minimum output value of the data drive unit 120 regardless of the characteristics of the display panel 140) is driven, a difference in horizontal crosstalk occurrence level is caused depending on values of drive component characteristics/gamma data, so the horizontal crosstalk may increase.

Figure 6:
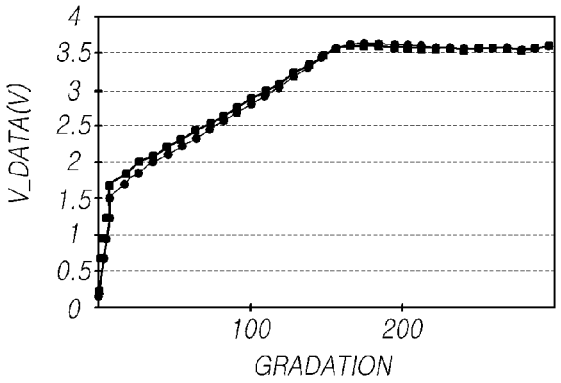
FIG. 6 is a graph representing a data voltage V_data according to a gradation level.

FIG. 6 is a graph representing a data voltage V_data according to gradation.

Referring to FIG. 6, there are variations ΔV of data voltages from black (gradation level of 0) to a high gradation level. The larger the data variation ΔV (from black (gradation level of 0) to the high gradation level) is, the higher the crosstalk level may be.

As described above, since the black data voltage when displaying the black is fixed to the minimum output value of the data drive unit 120, the variation in the data voltage between the black and the high gradation level at the time of gamma expression (for example, ΔV is equal to 3V or higher) may increase.

Figure 7:
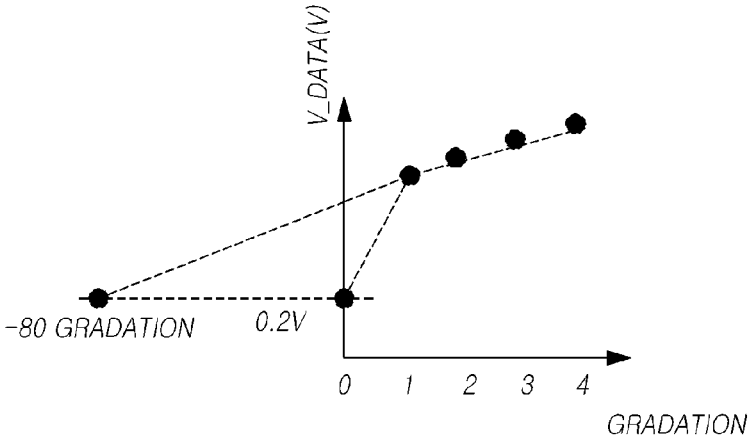
FIG. 7 illustrates a method of converting a black data voltage into a gradation level when the black data voltage is the first voltage corresponding to the minimum output value of the data drive unit.

FIG. 7 illustrates a method of converting a black data voltage into a gradation level when the black data voltage is the first voltage which corresponds to the minimum output value of the data drive unit.

As shown in FIG. 7, when the black data voltage at the time of displaying black is set to the first voltage corresponding to the minimum output value of the data drive unit 120, for example, 0.2V, the black data voltage can be converted into a gradation value (or gradation level) by linearly extending the black data voltage of 0.2V and measurable data voltages of two or more low gradation levels, for example, data voltages of low gradation levels of 1 to 4. As a result, the black data voltage of 0.2V can be converted to a value similar to a configured gradation level of −80. Accordingly, at the time of change from black to a high gradation level (e.g. gradation level of 127), a variation corresponding to about a gradation level of 207 [(a gradation level of 127)−(a gradation level of −80)=(a gradation level of 207)] may occur in the data voltage.

Accordingly, the data voltage variation from black to a high gradation level in the boundary area of the black window box may increase, resulting in increased horizontal crosstalk.

The display device 100 may set the black data voltage, corresponding to a gradation level of 0 expressing black, to a third voltage, (which is higher than the first voltage and is less than or equal to a second voltage obtained as a voltage corresponding to the gradation level of 0) by linearly extending two or more data voltages of low gradation levels, and may decrease the variation in data voltage between gradation levels from black to the high gradation level, which reduces horizontal crosstalk.

Figure 8:
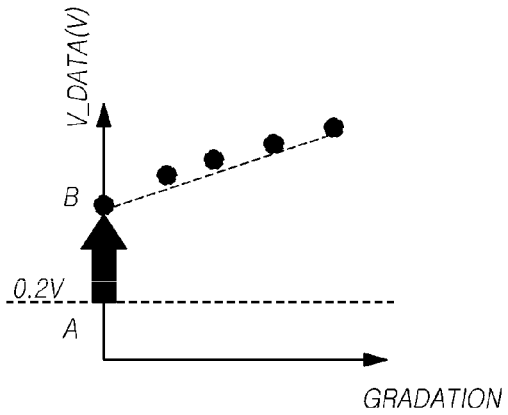
FIGS. 8 and 9 are graphs of a data voltage according to a gradation obtained by changing a data voltage to reduce horizontal crosstalk.
Figure 9:
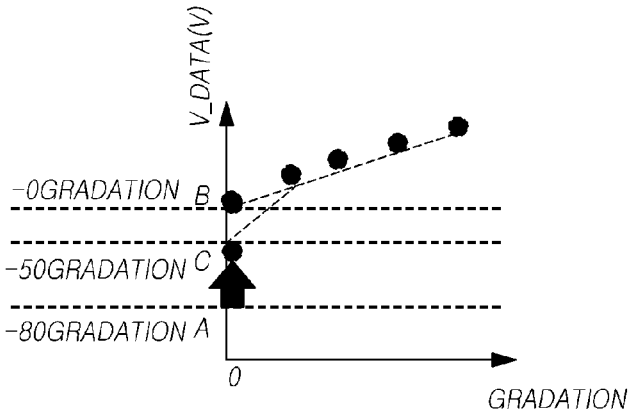

FIGS. 8 and 9 are graphs of data voltage according to gradation level obtained by changing a black data voltage to reduce horizontal crosstalk.

Referring to FIG. 8, the display device 100 may set a second voltage (B in FIG. 8) corresponding to a gradation level of 0 by linearly extending data voltages of two or more low gradation levels adjacent to 0.2 nit, which is a measurable luminance, for example, low gradation levels of 1 to 4, as the black data voltage. Here, extending of data voltages of low gradation levels may refer to, for example, linearly approximating and extending the data voltages of the low gradation levels.

In FIG. 8, although it has been described that the display device 100 sets the first voltage obtained as a voltage corresponding to a gradation level of 0 (by extending the voltages of two or more gradation levels adjacent to 0.2 nit which is a measurable luminance (for example, low gradation levels of 1 to 4) as the black data voltage), the present invention is not limited to this. For example, a fourth voltage [obtained as a voltage corresponding to a gradation level of 0 by extending data voltages of measurable low gradation levels (for example, low gradation levels of 1 to 4) along an exponential curve such as $Y=BX^{(1/gamma\ value)}$ (A is a constant, Y is a magnitude of a data voltage, and X is a gradation level) which is a gamma value multiplication curve (for example, the gamma value is between 2.0 and 2.5)] may be set as the black data voltage. Also in this case, extending the data voltages of low gradation levels along a gamma value multiplication curve may refer to, for example, approximating and extending data voltages of low gradation levels along the gamma value multiplication curve.

Referring to FIG. 9, in consideration of the output margin of the data voltage output from the data drive unit 120, the display device 100 may set the fifth voltage in the area between B and C corresponding to gradation levels of −50 and 0 (in view of gradation values, respectively, obtained by linearly extending data voltages of two or more measurable low gradation levels), as the black data voltage. In other words, when the black data voltage is set by linearly or exponentially extending data voltages of low gradation levels as described above with reference to FIG. 8, the data voltage output from a particular data drive unit 120 is not constant, which may cause an actually output black data voltage to be higher than the set black data voltage. Therefore, in order to prevent output of a high actual black data voltage, a fifth voltage between the second voltage or fourth voltage (obtained by linearly or exponentially extending data voltages of two or more low gradation levels, and the first voltage, corresponding to the minimum output value of the data drive unit 120, for example, the fifth voltage having a value of 0.5V to 1.1V in the area between B and C corresponding to gradation levels of −50 and 0 in view of gradation values, respectively, obtained by linearly extending data voltages of two or more measurable low gradation levels) can be set as the black data voltage.

As described above with reference to FIG. 1, when the display device 100 has (n×m) pixels formed on the display panel, since driving transistors, which are driving elements of pixels, have threshold voltages different according to the pixels, the display device 100 may internally or externally compensate for the threshold voltages of the drive transistors. The display device 100 may measure threshold voltages of the drive transistors or differences of the threshold voltages and then internally compensate for the threshold voltages by an internal circuit itself or externally compensate for the threshold voltages by converting video data applied to each pixel. As another example, the display device 100 may set a sixth voltage, (which is obtained by adding a threshold voltage compensation value of a drive element to the first voltage, e.g., the minimum output value of the data drive unit 120) as the black data voltage. The threshold voltage compensation value of a drive element may correspond to, for example, an average value of threshold voltages of drive transistors of (n×m) pixels of the display panel 140 or (the average value±standard deviation).

As a result, the display device 100 may set a black data voltage according to the characteristic of the display panel 140 and reflect the characteristic change of the drive element to compensate for the black data voltage together with internal compensation or external compensation.

Although the display device 100 equally compensates for the n number of black data voltages of the display panel 140 by reflecting the variance of the threshold voltages of drive transistors of (n×m) pixels of the display panel 140 in the above description, the display device 100 may compensate for the black data voltage of each pixel by reflecting the variance of the threshold voltages of drive transistors of (n×m) pixels of the display panel 140.

In other words, as described above with reference to FIGS. 8 and 9, the display device 100 may set a third voltage, (which is higher than the first voltage (A of FIG. 9) corresponding to the minimum output value of the data drive unit 120 and is equal to or lower than the second voltage (B of FIG. 9) obtained by linearly extending data voltages of two or more low gradation levels) as the black data voltage.

To this end, when the display device 100 is manufactured or used, gamma data (in which a third voltage, which is higher than the first voltage (A of FIG. 9) corresponding to the minimum output value of the data drive unit 120 and is equal to or lower than the second voltage (B of FIG. 9) obtained by linearly extending data voltages of two or more low gradation levels, is set as the black data voltage) is stored in the memory 152.

For example, as described above with reference to FIG. 4, gamma data as shown in Table 2 (in which a first gamma reference voltage GRV_1 is set as V1' when the third voltage, which is higher than the minimum output value (A of FIG. 9) of the data drive unit 120 and is equal to or lower than the second voltage (B of FIG. 9) corresponding to the gradation level 0 obtained by linearly extending data voltages of two or more low gradation levels, is V1' and other gamma reference voltages have values as shown in Table 1) is stored in the memory 152.

TABLE 2

| Gamma Data | | | | | | | | | |
|---|---|---|---|---|---|---|---|---|---|
| | Gamma Ref. Value | | | | | | | | |
| | GRV_1 | GRV_2 | GRV_3 | GRV_4 | GRV_5 | GRV_6 | GRV_7 | GRV_8 | GRV_9 |
| Magnitude | V1' | V2 | V3 | V4 | V5 | V6 | V7 | V8 | V9 |

The gamma reference voltage unit 153 generates gamma reference voltages based on the gamma data of Table 2 stored in the memory 152 and the gamma voltage unit 154 generates gamma voltages by using the gamma reference voltages.

The gamma voltage unit 154 includes two or more resistors arranged in series and applies the generated gamma voltages to opposite nodes of the resistors and nodes between the resistors. The gamma reference voltage unit 153 may provide a first gamma reference voltage to one node among the opposite nodes of the resistors and the nodes between the resistors. For example, since the first gamma reference voltage GRV_1 is supplied to the first node n1 and the lowest electric potential of the first gamma voltage GV_1 is thus equal to the lowest electric potential of the first gamma reference voltage GRV_1, the black data voltage corresponding to the gradation level of 0 may be equal to the first gamma voltage GV_1 in FIG. 4.

As a result, the data drive unit 120 can output a third voltage, (which is higher than the first voltage corresponding to the minimum output value and is equal to or lower than the second voltage corresponding to the gradation level of 0 obtained by linearly extending data voltages of two or more low gradation levels) as a black data voltage corresponding to the gradation level of 0 expressing black, through a data line. In this event, the third voltage may be one of the fourth voltage, the fifth voltage, or the sixth voltage.

As a result, the display device 100 according to the embodiment described above can achieve a relatively high black data voltage corresponding to the gradation level of 0 and thus can reduce the horizontal crosstalk in a boundary part of the black window box illustrated in FIG. 5.

Further, the display device 100 according to the embodiment described above can set an optimum black data voltage for each display panel according to the characteristic of the display panel 140.

The embodiments described above with reference to the accompanying drawings do not limit the scope of the present invention.

Although the gamma voltage supply unit 150 divides the gamma reference voltage to generate gamma voltages corresponding to gradation levels and supplies the gamma voltages to the data drive unit 120 in the embodiments described above, the present invention is not limited to the described construction. Instead, the data drive unit 120 may divide the gamma reference voltage from the gamma voltage supply unit 150 to generate gamma voltages corresponding to gradation levels, convert digital video data (R'G'B') voltages to analog data voltages (Vout1 to Voutn) by using the generated gamma voltages, and then apply the converted voltages to the data lines DL1 to DLn. In other words, the gamma voltage unit 154 included in the gamma voltage supply unit 150 may be located in the data drive unit 120. In this event, the gamma voltage supply unit 150 may not include an output buffer.

The present invention is not limited to the embodiments described above in which a memory 152 stores gamma data including magnitudes of gamma reference voltages and adjusts the gamma reference voltages to control gamma voltages. For example, the memory 152 may store gamma data including magnitudes of gamma voltages while fixing the gamma reference voltages. In this event, the gamma reference voltage unit 153 may supply the fixed gamma reference voltages to the gamma voltage unit and the gamma voltage unit 154 may generate gamma voltages according to the gamma voltages stored in the memory 152. Specifically, in the gamma voltage unit described above with reference to FIG. 4, the resistors connected in series may be configured by variable resistors, which are controlled according to the magnitudes of the gamma voltages stored in the memory 152, to generate gamma voltages.

In addition, since terms, such as "including," "comprising," and "having" mean that one or more corresponding components may exist unless they are specifically described to the contrary, it shall be construed that one or more other components can be included. All of the terminologies containing one or more technical or scientific terminologies have the same meanings that persons skilled in the art understand ordinarily unless they are defined otherwise. A term ordinarily used like that defined by a dictionary shall be construed that it has a meaning equal to that in the context of a related description, and shall not be construed in an ideal or excessively formal meaning unless it is clearly defined in the present specification.

Although the embodiments of the present invention have been described for illustrative purposes, those skilled in the art will appreciate that various modifications, additions and substitutions are possible, without departing from the scope and spirit of the invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

a display panel in which a plurality of data lines and a plurality of gate lines intersect in a matrix form and pixels are formed at intersecting points thereof;

a data drive unit connected to the plurality of data lines, the data drive unit outputting a black data voltage corresponding to a gradation level of 0, the data drive unit expressing the black data voltage through the data lines, the black data voltage being greater than a minimum output voltage supplied to data lines by the data drive unit and less than a voltage obtained by linearly extending data voltages of two or more low gradation levels to the gradation level of 0, the two or more low gradation levels greater than the gradation level of 0 and including gradation levels 1, 2, 3, and 4;

a gamma voltage supply unit outputting a gamma voltage for each gradation level to the data drive unit; and a timing controller generating a control signal to control driving of the display panel.

2. The display device of claim 1, wherein the black data voltage is obtained by exponentially extending the data voltages of the two or more low gradation levels to the gradation level of zero.

3. The display device of claim 1, wherein the black data voltage is obtained by linearly extending the data voltages of the two or more low gradation levels to a gradation level greater than or equal to −50 and less than 0.

4. The display device of claim 1, wherein the black data voltage is obtained by adding a compensation value to the minimum output voltage, the compensation value corresponding to a threshold voltage of a drive transistor formed in a pixel of the display panel.

5. The display panel of claim 4, wherein the display panel includes two or more pixels, and the compensation value is obtained from an average value of compensation values corresponding to threshold voltages of respective drive transistors formed in the two or more pixels.

6. The display panel of claim 1, wherein the gamma voltage supply unit comprises:

a memory storing two or more gamma data used for generating two or more gamma reference voltages including a first gamma reference voltage serving as a basis for generating the black data voltage;

a gamma reference voltage unit to generate the gamma reference voltages based on the gamma data stored in the memory; and a gamma voltage unit to generate the gamma voltages using the gamma reference voltages.

7. The display device of claim 6, wherein the gamma voltage unit is positioned in the data drive unit.

8. The display device of claim 6, wherein the gamma voltage unit includes two or more resistors arranged in series, and the gamma voltages correspond to voltages at nodes of both ends of the resistors and nodes between the resistors, and the gamma reference voltage unit supplies the first gamma reference voltage to at least one of the nodes of the both ends of the resistors and the nodes between the resistors.

9. The display device of claim 6, wherein the memory is positioned inside of the gamma voltage supply unit, and further comprising an additional memory positioned inside of the timing controller.

10. The display device of claim 9, wherein the timing controller changes the gamma data stored in the memory through a controller of the gamma voltage supply unit.

11. The display device of claim 6, wherein the gamma data stored in the memory contain different gamma reference voltages for red pixels (R), green pixels (G), and blue pixels (B), the different gamma reference voltages used to generate different gamma voltages for the red pixels (R), green pixels (G), and blue pixels (B).

12. The display device of claim 6, wherein the gamma reference voltage unit generates the gamma reference voltage using a power supply voltage Vdd applied by a power supply unit.

13. The display device of claim 6, wherein the gamma voltage unit generates gamma voltages using serially connected resistors as voltage dividers between the gamma reference voltages, the gamma voltages comprising a greater number of gamma voltages than a number of the gamma reference voltages.

14. The display device of claim 1, wherein the display is an organic light emitting diode display panel.

15. The display device of claim 4, wherein the display panel includes two or more pixels having compensation values corresponding to threshold voltages of respective drive transistors formed in the two or more pixels, and the compensation value is one of: (a) an average value of the compensation values added to a standard deviation of the compensation values and (b) the standard deviation subtracted from the average value.

16. The display device of claim 1, wherein the minimum output voltage supplied to the data lines by the data drive unit is a non-zero voltage.

17. A display device comprising:

a display panel in which a plurality of data lines and a plurality of gate lines intersect in a matrix form and pixels are formed at intersecting points thereof;

a data drive unit connected to the plurality of data lines, the data drive unit outputting a black data voltage corresponding to a gradation level of 0, the data drive unit expressing the black data voltage through the data lines, the black data voltage being greater than a minimum output voltage supplied to data lines by the data drive unit and less than to a voltage obtained by linearly extending data voltages of two or more low gradation levels to the gradation level of 0, the two or more low gradation levels greater than the gradation level of 0, the two or more low gradation levels including at least two of gradation levels 1, 2, 3, and 4;

a gamma voltage supply unit outputting a gamma voltage for each gradation level to the data drive unit; and a timing controller generating a control signal to control driving of the display panel.

18. The display device of claim 17, wherein the black data voltage is obtained by exponentially extending the data voltages of the two or more low gradation levels to the gradation level of zero.

19. The display device of claim 17, wherein the black data voltage is obtained by linearly extending the data voltages of the two or more low gradation levels to a gradation level greater than or equal to −50 and less than 0.

20. The display device of claim 17, wherein the black data voltage is obtained by adding a compensation value to the minimum output voltage, the compensation value corresponding to a threshold voltage of a drive transistor formed in a pixel of the display panel.

* * * * *